United States Patent [19]

Bower

[11] 4,091,554

[45] May 30, 1978

[54] ORNAMENTAL REPLACEABLE LETTER DISPLAYING DEVICE

[76] Inventor: Richard R. Bower, 3708 Crownridge Dr., Sherman Oaks, Calif. 91403

[21] Appl. No.: 774,637

[22] Filed: Mar. 4, 1977

[51] Int. Cl.[2] ..... G09F 7/02

[52] U.S. Cl. ..... 40/623; 63/20; 40/1.5

[58] Field of Search ..... 40/1.5, 1.6, 140, 142, 40/20 A; 63/20, 31

[56] References Cited

U.S. PATENT DOCUMENTS

| | | | |
|---|---|---|---|
| 466,344 | 1/1892 | Groenman | 63/20 |
| 917,604 | 4/1909 | Herzog | 40/140 |
| 1,581,006 | 4/1926 | McClarence | 40/20 A |
| 2,209,714 | 7/1940 | Chernow | 40/140 |
| 2,289,423 | 9/1954 | Atkin | 40/1.6 X |
| 3,579,881 | 2/1969 | Cherry | 40/1.5 |

*Primary Examiner*—Louis G. Mancene

*Assistant Examiner*—Wenceslao J. Contreras

*Attorney, Agent, or Firm*—Christie, Parker & Hale

[57] ABSTRACT

A medallion or the like for displaying letters or monograms in which the individual letters can be inserted or removed to permit any combination of letters to be displayed. The medallion, which can be used as a belt buckle, pin, clasp or other decorative or ornamental device, utilizes individual flat letters mounted tangentially on tubular members. The tubular members are slidable on a supporting rod. The ends of the rod are removably attached to one side of a slightly bowed metal plate having an elongated opening, the rod extending lengthwise of the opening on the concave side of the plate with the letters bridging the width of the opening on the convex side of the plate. The letters are held in position by the clamping action between the letters and one side of the plate and the anchored ends of the rod on the other side of the plate.

7 Claims, 8 Drawing Figures

Fig. 1
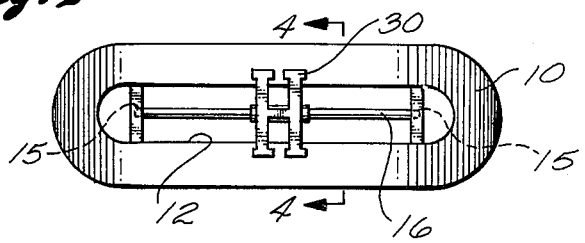
Fig. 2
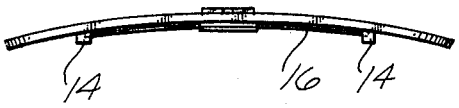
Fig. 3
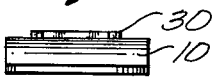
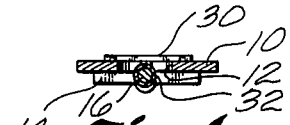
Fig. 4
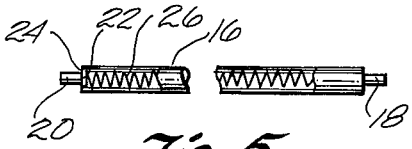
Fig. 5
Fig. 6
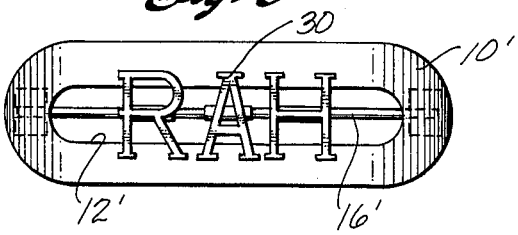
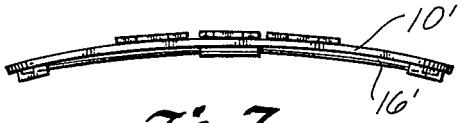
Fig. 7
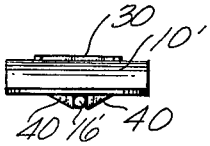
Fig. 8

ORNAMENTAL REPLACEABLE LETTER DISPLAYING DEVICE

FIELD OF THE INVENTION

This invention relates to monogram display devices with replaceable letters.

BACKGROUND OF THE INVENTION

Various types of ornamental devices such as buckles, pins, clasps, and the like, are designed to display a person's initials. It is desirable that the letters be replaceable so that the letters can be selected by the purchaser and inserted at the time the ornamental device is sold. While various types of replaceable letter systems have been devised, there is a need for a simple letter-mounting arrangement for metal devices which does not require any special crimping tools or other clamping arrangements for locking the letters in place.

SUMMARY OF THE INVENTION

The present invention is directed to an improved monogram display device with interchangeable letters which is characterized by its simplicity of construction and which requires no special tools to replace the letters, and yet provides a pleasing and rich-looking metallic display unit which can be used as a belt buckle or other functional or ornamental device. This is accomplished in brief by providing a decorative device, including a thin slightly bowed metal plate having an elongated opening or slot extending in the direction the plate is bowed. Thin metal individual letters or symbols, preferably cut or cast from suitable metal, are secured tangentially across the center to tubular sections which slide onto a rod. The rod is removably attached to the metal plate or the concave side. The rod extends lengthwise of the opening with the letters engaging the margins of the opening on the opposite side of the plate. The plate is flattened slightly by the rod and letters so as to urge the engaging letters away from the rod and thereby secure the letters in position along the length of the rod.

DESCRIPTION OF THE DRAWINGS

For a better understanding of the invention, reference should be made to the accompanying drawings wherein:

FIG. 1 is an elevational view of one embodiment of the invention;

FIG. 2 is an edge view of the embodiment of FIG. 1;

FIG. 3 is an end view of the embodiment of FIG. 1;

FIG. 4 is a sectional view taken substantially on the line 4—4 of FIG. 1;

FIG. 5 is an enlarged view showing the construction of a portion of the embodiment of FIG. 1;

FIG. 6 is an elevational view of an alternative embodiment of the invention;

FIG. 7 is an edge view of the embodiment of FIG. 6; and

FIG. 8 is an end view of the embodiment of FIG. 6.

DETAILED DESCRIPTION

Referring to the preferred embodiment of FIG. 1, the numeral 10 indicates generally a thin metal plate made of any suitable metal, such as brass, silver, or plated base metal preferably having a sufficient resilience so as not to be easily bent. Metal plate 10 is provided with an elongated opening or a slot 12. While the plate can take a variety of shapes, preferably the edges of the elongated slot 12 are parallel so as to be of substantially constant width.

A pair of anchoring lugs 14 are secured to one surface of the plate 10 adjacent either end of the opening 12. The lugs 14 have openings 15 for receiving the ends of a rod 16. The lugs 14 anchor the ends of rod 16 with the rod extending lengthwise of the opening 12.

As shown in FIG. 5, the rod 16 is preferably constructed from a tubular member having closed ends from which project a pair of end pins 18 and 20. The pins are formed with a retaining head 22 which fits inside the tubular section 16 of a length only slightly less than the distance between the lugs. The ends of the tubular section are then crimped over, as indicated at 24 to restrain the heads of the pins. A coil compression spring 26 positioned inside the tubular section 16 forces the heads of the pins 18 and 20 outwardly against the crimped ends.

By pressing inwardly on the ends of the pins, the spring 26 is compressed allowing the pins to telescope inwardly inside the tube. The lugs 14 are formed with small bores or openings 15 which received the pins 18 and 20. Thus, by compressing the pins into the rod 16, the rod 16 can be inserted between the lugs 14. The compression spring 26 causes the pins to snap outwardly into the openings 15 in the lugs 14, thereby locking the rod in place. The rod can be removed by inserting a plunger tool, such as a pin or needle, into the openings 15 to compress the pins into the tubular portion of the rod thereby permitting the rod to be detached from the lugs 14.

The rod 16 is arranged to anchor one or more individual letters or symbols which are displayed as a monogram on the front of the plate 10. The individual replaceable letters, one of which is indicated at 30, are formed from a thin metal such as brass which is soldered or otherwise secured tangentially to the surface of a tubular section 32. The tubular section extends laterally behind the letter along the center of the letter. The size of the letters is such that the height of the letters in a direction transversed to the axis of that tubular section 32 is greater than the width of the opening 12. One or more letters are assembled on the rod 16 by inserting the rod through the tubular section 32. The rod is then assembled by inserting one end of the rod through the opening 12 from the front of the plate and inserting the pin at the end of the rod into the opening in one of the lugs 14. This leaves the letters 30 on the opposite side (the front side) of the plate 10 from the lugs 14. The letters are then spaced along the rod 16 at the desired positions and the free end of the rod 16 is pushed downwardly through the opening 12 until the pin 20 snaps into position in the opposite lug 14 so that both ends of the rod are now anchored. The offset of the letters 30 from the central axis of the tubular section 32 is such that when the ends of the rod 16 are anchored, the letters are securely clamped to the outer surface of the plate 10. The plate 10 is preferably formed with a slight bow, as shown in exaggerated form in FIG. 2. The plate 10 must be flattened slightly to insert the pins at both ends into the respective lugs. The flattening of the plate 10 produces a restoring force which acts against the underside of the letters 30 and is resisted by the rod 16. Thus, a clamping action is produced between the underside of the letters 30 and the outer convex surface of the plate 10 which acts to hold the letters securely in position against the front of the plate 10. By simply flattening the plate 10 slightly this clamping action can be relieved, permitting the rod 16 to be easily removed if it is desired to replace the letters.

An alternative arrangement is shown in FIGS. 6, 7 and 8 in which a rod 16' is made longer than the length of a longitudinal opening 12 in the plate 10. The letters 30 and attached tubular sections 32 are identical to the arrangement shown in FIGS. 1–5. However, the rod 16' is preferably a solid metal rod without the telescoping pins.

In the embodiment of FIGS. 6–8, the monogram is assembled by positioning the selected letters on the rod 16' and inserting one end of the rod 16' through the opening 12 and into a position beyond the closed end of the elongated opening. The rod is inserted far enough beyond the end of the opening 12 so that the other end of the rod 16' can be pushed through the opposite end of the opening 12. The rod 16' is then shifted longitudinally so that both ends are locked against the underside of the plate 10' at either end of the slot 12'. This causes the convex side of the plate 10' to press against the underside of the letters 30 thereby clamping the letters 30 securely in position.

The ends of the rod 16' are preferably restrained laterally by tapered stop members 40 secured to the underside of the plate 10 on either side of the ends of the rod 16'. It should be noted that the arcuate shape of the plate 10' is exaggerated in FIG. 7 and that the rod 16, while bent slightly by the spring action of the plate 10 against the underside of the letters 30, in actual practice appears to remain substantially straight. Thus, in practice, the rod 16 is made straight and the plate 10' is bowed only slightly so that it creates a force against the underside of the letters 30, providing clamping action by the rod 16 engaging one side of the plate and the letters 30 engaging the other side of the plate. This causes the plate to be flattened slightly, producing a restoring force that acts to hold the letters and rod securely in position.

What is claimed is:

1. A decorative device for displaying replaceable letters or the like comprising: a thin metal plate having an elongated slot closed at both ends, a thin rod and plurality of replaceable letter units, each letter unit including a thin flat section shaped to conform to a letter or symbol, and a tubular member to which the flat section is secured in tangential relationship the flat section extending a distance transverse to the tube a distance greater than the width of said slot, the flat section of the letter units bridging the narrow dimension of the slot on one side of the plate, the rod extending through the tubular member, means securing the ends of the rod to the plate; the rod extending the long dimension of the slot on the opposite side of the plate, the plate being clamped between the outer ends of the rod and the bridging letter sections of the letter units.

2. Apparatus of claim 1 wherein the rod includes two telescoping end portions and spring means urging the end portions apart, and lug means secured to the plate adjacent either end of the slot having opening for receiving the ends of the rod to removably secure the rod in position.

3. Apparatus of claim 1 wherein the plate is bowed slightly in the longitudinal direction of the slot, the letter section engaging the plate on the convex side of the bowed plate.

4. Apparatus of claim 2 wherein the plate is bowed slightly in the longitudinal direction of the slot, the letter section engaging the plate on the convex side of the bowed plate.

5. A medallion or the like comprising a thin elongated metal plate having a central elongated opening, removable thin metal symbols having one dimension greater than the width of the opening, means holding the symbols against the surface of the plate on either side of the slot including a tubular member secured to the symbols with the surface of the symbols being tangential to the central axis of the tubular member and a rod extending through the tubular member, and means anchoring the ends of the rod to plate with the rod extending lengthwise of the opening, the plate being curved slightly in the longitudinal direction of the opening, the offset distance between the center of the tubular member and the surface of the metal symbol to which the tubular member is secured being slightly less than the axis of the rod and the surface of the plate engaging the symbol.

6. The apparatus of claim 5 wherein said means anchoring ends of the rod includes lugs having openings therein, the ends of the rod engaging said openings.

7. The apparatus of claim 6 wherein the rod includes telescoping end portions and spring means urging the end portions apart.

* * * * *